United States Patent [19]

Inoue et al.

[11] Patent Number: 4,920,029

[45] Date of Patent: Apr. 24, 1990

[54] SILVER HALIDE PHOTOGRAPHIC MATERIAL AND METHOD FOR FORMING SUPER HIGH CONTRAST NEGATIVE IMAGES THEREWITH

[75] Inventors: Nobuaki Inoue; Senzo Sasaoka; Yoshio Inagaki; Tetsuro Kojima; Morio Yagihara, all of Kanagawa, Japan

[73] Assignee: Fuji Photo Film Co., Ltd., Kanagawa, Japan

[21] Appl. No.: 235,805

[22] Filed: Aug. 23, 1988

Related U.S. Application Data

[63] Continuation of Ser. No. 906,465, Sep. 12, 1986, abandoned.

[30] Foreign Application Priority Data

Sep. 18, 1985 [JP] Japan ..... 60-206093

[51] Int. Cl.[5] ..... G03C 1/06

[52] U.S. Cl. ..... 430/264; 430/949

[58] Field of Search ..... 430/264, 949

[56] References Cited

U.S. PATENT DOCUMENTS

| | | | |
|---|---|---|---|
| 4,243,739 | 1/1981 | Mifune et al. | 430/949 |
| 4,272,614 | 6/1981 | Mifune et al. | 430/949 |
| 4,323,643 | 4/1982 | Mifune et al. | 430/949 |
| 4,429,036 | 1/1984 | Hirano et al. | 430/949 |
| 4,569,904 | 2/1986 | Okutsu et al. | 430/949 |
| 4,681,836 | 7/1987 | Inoue et al. | 430/949 |
| 4,725,532 | 2/1988 | Kameoka et al. | 430/566 |
| 4,737,452 | 4/1988 | Kameoka et al. | 430/600 |
| 4,755,448 | 7/1988 | Katoh | 430/266 |
| 4,755,449 | 7/1988 | Inoue et al. | 430/267 |
| 4,777,113 | 10/1988 | Inoue et al. | 430/264 |
| 4,789,618 | 12/1988 | Inoue et al. | 430/264 |
| 4,800,150 | 1/1989 | Katoh | 430/264 |
| 4,824,774 | 4/1989 | Inoue et al. | 430/566 |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A negative type silver halide photographic material and a process for forming a super high contrast negative image using said material are described. This photographic material comprises a support having provided thereon at least one silver halide emulsion layer which has a substantial influence upon image density and at least one light-insensitive hydrophilic colloid layer, wherein a hydrophilic colloid layer other than said silver halide emulsion layer contains a hydrazine derivative in a non-diffusing condition. With this photographic material, a super high contrast negative image can be obtained without decreasing sensitivity and gamma by the use of a developer containing not less than 0.15 mol/liter of sulfite ions and having a pH of from 10.5 to 12.3.

18 Claims, No Drawings

SILVER HALIDE PHOTOGRAPHIC MATERIAL AND METHOD FOR FORMING SUPER HIGH CONTRAST NEGATIVE IMAGES THEREWITH

This is a continuation of application Ser. No. 06/906,465, filed Sept. 12, 1986, now abandoned.

FIELD OF THE INVENTION

The present invention relates to a silver halide photographic material and a method for forming super high contrast negative images using said material. More particularly, it is concerned with a silver halide photographic material for use in the photo-mechanical process and a method for forming super high contrast negative images using said material.

BACKGROUND OF THE INVENTION

In the field of graphic art, a method for forming images exhibiting photographic characteristics such that the contrast is quite high (particularly a gamma value of 10 or more) is needed to ensure good reproduction of images of continuous gradation comprising dot images or good reproduction of line images.

For this method, a special developer called a "lith developer" has heretofore been used. This lith developer contains only hydroquinone as a developing agent, and is greatly decreased in the concentration of free sulfite ions (usually not more than 0.1 mol/liter) by using a sulfurous acid salt as a preservative in the form of a formaldehyde adduct so as not to deteriorate the infectious developing properties of the lith developer. Therefore, the lith developer has a serious disadvantage in that it is quite easily subjected to air oxidation; thus, it cannot be stored for more than 3 days.

To obtain good photographic characteristics such as high contrast, a method of using hydrazine derivatives is known, as described, for example, in U.S. Pat Nos. 4,224,401, 4,168,977, 4,166,742, 4,311,781, 4,272,606, 4,211,857, 4,243,739, etc. This method permits the formation of images exhibiting photographic characteristics such as super high contrast and high sensitivity, and furthermore, since a high concentration of a sulfurous acid salt can be added to the developer to be used, the stability of the developer against air oxidation is greatly increased as compared with the lith developer.

The above method, however, causes the undesired phenomenon, e.g., formation of black spots due to infections development although it provides high sensitivity and high contrast, and produces a serious problem in the photo-mechanical process. The black spots are formed in non-exposed areas between halftone dots (sometimes called black pepper). This phenomenon becomes particularly conspicuous when the sulfite ion content in a developer is decreased or the pH of a developer increases due to fatigue of the developer which is stored for a long period of time, particularly under high temperature/high humidity condition, and it causes a significant reduction in photographic quality.

Various attempts have hitherto been made in order to eliminate the problem of black spots, but such improvements are frequently accompanied by reduction in sensitivity and gamma value. Thus, no means has been known for solving the problem of black spots without hindering the effect using the above-described hydrazine compounds to increase sensitivity and contrast.

SUMMARY OF THE INVENTION

An object of the present invention is to provide a silver halide photographic material which forms an image exhibiting photographic characteristics such that the sensitivity and contrast are high to such an extent that the gamma is in excess of 10, and that the formation of black spots is markedly reduced, even when developed with a stable developer.

Another object of the present invention is to provide an image-forming method using the above silver halide photographic material.

The present invention is directed to a negative type silver halide photographic material comprising a support having provided thereon at least one silver halide emulsion layer which has a substantial influence upon image density and at least one light-insensitive hydrophilic colloid layer, wherein a hydrophilic colloid layer other than said silver halide emulsion layer contains a hydrazine derivative in a non-diffusing condition, and to a process for forming a super high contrast negative image which comprises imagewise exposing the above silver halide photographic material and then processing it with a developer containing at least 0.15 mol/liter of sulfite ion and having a pH of from 10.5 to 12.3.

DETAILED DESCRIPTION OF THE INVENTION

The "non-diffusing condition" as used herein means that in a light-sensitive material prior to development, a major portion of the hydrazine derivatives is present in a layer other than said silver halide emulsion which has a substantial influence upon image density, but when processed with an alkali developer, the hydrazine derivative can diffuse into the silver halide emulsion layer which has a substantial influence upon image density.

Examples of the hydrophilic colloid layer other than the silver halide emulsion layer which have a substantial influence upon image density include light-insensitive hydrophilic colloid layers (e.g., a protective layer, an interlayer, a filter layer, and an antihalation layer) and a silver halide emulsion layer which does not have a substantial influence upon image density (e.g., an emulsion layer containing a finely divided silver halide (having an average grain size of 0.2 μm or less) emulsion which is not subjected to chemical sensitization or an emulsion layer containing a low sensitive emulsion which contains in a large amount of rhodium). Preferably, the hydrazine compound is used in a light-insensitive hydrophilic colloid layer.

A "silver halide emulsion layer which has a substantial influence upon image density" as used herein means an emulsion layer influential for at least 55% of the maximum image density. That is, said silver halide emulsion layer comprises a silver halide emulsion, wherein when subjected to a developing treatment, the gamma is not less than 10 and, the maximum image density is 4 or more, and preferably in excess of 5.

Known hydrazines can be used as the hydrazine derivative as used herein. For example, the compounds described in or referred to in Japanese patent application (OPI) No. 83028/85 (the term "OPI" as used herein means a "published unexamined patent application"), U.S. Pat. No. 4,478,928, *Research Disclosure*, Vol. 235, RD No. 23510 (Sept., 1983), etc. can be used.

In order to incorporate the hydrazine derivative in a light-sensitive material in the non-diffusing condition, it suffices that the hydrazine derivative is designed so that it can diffuse into the silver halide emulsion layer which has a substantial influence upon image density when processed with an alkali developer. This can be achieved by various methods. For example, a method using such hydrazine derivatives that are provided with diffusibility on coming into contact with the alkali developer, a method in which hydrazine derivatives having an absorbing group are preliminarily absorbed on primitive silver halide particles, and a method in which a layer containing a hydrazine derivative and a silver halide emulsion layer which has a substantial influence upon image density are coated successively can be employed.

Of these methods, a method using such hydrazine derivatives that are provided with diffusibility on coming into contact with the alkali developer and a method using hydrazine derivatives having an absorbing group are particularly preferred.

These two methods are hereinafter explained in more detail.

One of the methods for incorporating hydrazine derivatives in the non-diffusing condition is to incorporate the compounds represented by formula (I) as described below in a hydrophilic colloid layer. These compounds are of low diffusability in the neutral or acidic region, but in an alkaline developer (preferably having a pH of from 10.5 to 12.3) they are increased in hydrophilic properties as a result of release of the acidic group, becoming easily diffusible in the hydrophilic colloid, and then being diffused into the silver halide emulsion layer which has a substantial influence upon image density. This fact is believed to provide desirable results in the method of the present invention.

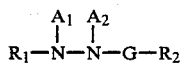

$$R_1-\overset{A_1}{\overset{|}{N}}-\overset{A_2}{\overset{|}{N}}-G-R_2 \quad (I)$$

In formula (I), $A_1$ and $A_2$ both represent hydrogen atoms, or one of $A_1$ and $A_2$ represents a hydrogen atom and the other represents a sulfinic acid residue; $R_1$ represents an aliphatic group, an aromatic group, or a heterocyclic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group, provided that at least one of $R_1$ and $R_2$ contains at least one group having a pKa of from 8 to 13 and which is capable of dissociating into an anionic ion. Preferred are compounds which do not contain a group having pKa of less than 8 and in which when the substituents are considered in combination the quotient of (molecular weight)/(number of dissociable groups plus 1) is from 150 to 650, because diffusibility in the neutral or acidic region can be thereby decreased, and thus there can be obtained an advantage in that preparation and handling become easy.

The sulfinic acid residue represented by $A_1$ and $A_2$ in formula (I) specifically indicates such groups described in U.S. Pat. No. 4,478,928. Preferably both of $A_1$ and $A_2$ represent hydrogen atoms. The aliphatic group represented by $R_1$ in formula (I) preferably has from 8 to 50 carbon atoms, and particularly preferably is a straight, branched, or cyclic alkyl group, having from 8 to 30 carbon atoms. This branched alkyl group may be cyclized so as to form a saturated hetero ring containing one or more hetero atoms. The alkyl group may have a substituent such as an aryl group, and alkoxy group, a sulfoxy group, a sulfonamido group, and a carbonamido group.

Typical examples include a tert-butyl group, an n-octyl group, a tert-octyl group, a cyclohexyl group, a pyrrolydyl group, an imidazolyl group, a tetrahydrofuryl group, and a morpholino group.

The aromatic or heterocyclic group represented by $R_1$ in formula (I) is preferably a monocyclic or dicyclic aryl group, or an unsaturated hetero ring group. The unsaturated hetero ring group may condense with a monocyclic or dicyclic aryl group to form a heteroaryl group.

Typical examples include a benzene ring, a naphthalene ring, a pyridine ring, a pyrimidine ring, an imidazole ring, a pyrrazole ring, a quinoline ring, an isoquinoline ring, a benzimidazole ring, a thiazole ring, and a benzothiazole ring. Of these compounds, those containing a benzene ring are preferred.

A particularly preferred example represented by $R_1$ in formula (I) is an aryl group.

The aryl group or unsaturated heterocyclic group represented by $R_1$ may be substituted. Typical examples of substituents include a straight, branched, or cyclic alkyl group (preferably having from 1 to 20 carbon atoms), an aralkyl group (preferably a monocyclic or dicyclic group in which the alkyl portion has from 1 to 3 carbon atoms), an alkoxy group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms). A particularly preferred example of substituents is an acylamino group or a ureido group.

The alkyl group represented by $R_2$ in formula (I) is preferably an alkyl group having from 1 to 4 carbon atoms, and may have a substituent such as a halogen atom, a cyano group, a carboxyl group, a sulfo group, an alkoxy group, and a phenyl group.

The aryl group which may be substituted, as represented by $R_2$ in formula (I), is preferably a monocyclic or dicyclic aryl group and includes, for example, groups containing a benzene ring. This aryl group may be substituted with a group such as a halogen atom, an alkyl group, a cyano group, a carbonamido group, and a sulfonamido group.

The alkoxy group which may be substituted, of the groups represented by $R_2$ in formula (I), is preferably an alkoxy group having from 1 to 8 carbon atoms, which may be substituted with a halogen atom, an aryl group, or the like.

The aryloxy group which may be substituted, of the groups represented by $R_2$ in formula (I), is preferably a monocyclic group, and examples of the substituent include a halogen atom, etc.

Among the groups represented by $R_2$ when G is a carbonyl group, $R_2$ is preferably a hydrogen atom, a methyl group, a methoxy group, an ethoxy group, and a substituted or unsubstituted phenyl group, and particularly preferably a hydrogen atom.

When G is a sulfonyl group, $R_2$ is preferably a methyl group, an ethyl group, a phenyl group, or a 4-methyl-phenyl group, and particularly preferably a methyl group.

When G is a phosphoryl group, $R_2$ is preferably a methoxy group, an ethoxy group, a butoxy group, a phenoxy group, or a phenyl group, and particularly preferably a phenoxy group.

When G is a sulfoxy group, $R_2$ is preferably a cyanobenzyl group or a methylthiobenzyl group.

When G is an N-substituted or unsubstituted iminomethylene group, $R_2$ is preferably a methyl group, an ethyl group, or a substituted or unsubstituted phenyl group.

In $R_1$ or $R_2$ of formula (I), may be incorporated a ballast group which is commonly used in immobile photographic additives such as a coupler. The ballast group is a group having at least 8 carbon atoms and being relatively inert to photographic properties. Examples include an alkyl group, an alkoxy group, a phenyl group, an alkylphenyl group, a phenoxy group, and an alkylphenoxy group.

In $R_1$ or $R_2$ of formula (I), may be incorporated a group enhancing adsorption to the surface of silver halide particles. Examples of such adsorbing group include a thiourea group, a heterocyclic thioamido group, a mercapto heterocyclic group, a triazole group, and the like, described in U.S. Pat. No. 4,385,108.

As G of formula (I), a carbonyl group is most preferred.

The structure of the group having a pKa of from 8 to 13 of formula (I) is not critical as long as it does not substantially dissociate in a neutral or weakly acidic medium but is sufficiently dissociable in an alkaline aqueous solution (preferably having a pH of from 10.5 to 12.3). Examples include a hydroxyl group in the aromatic ring (preferably a phenoxy group substituted with a substituent having the sum of Hammet sigma values of not more than 0.5), a group represented by $-SO_2NH-$, a mercapto group, a hydroxyimino group ($>C{=}N-OH$), an active methylene group or an active methyl group (e.g., $-CH_2\overset{\ominus}{C}H_2-NO_2$, $-CH_2\overset{O}{\overset{\|}{C}}OC_2H_5$, $-CH_2\overset{O}{\overset{\|}{C}}CH_3$, $-\overset{CN}{\overset{|}{C}}H-COOC_2H_5$,

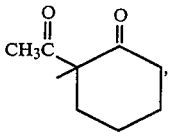

etc.), diacylamino group (e.g., $CH_3CONH-COCH_2CH_2-$,

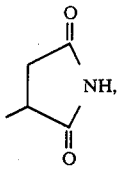

etc.), and azoles in which a nitrogen atom constituting the ring is linked to a hydrogen atom (e.g., groups having a skeleton such as imidazole, benzimidazole, benzthiazole, and benztriazole).

Representative examples of the compounds represented by formula (I) are shown below although the present invention is not limited thereto.

I-1

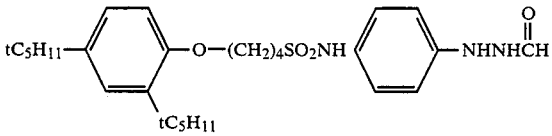

I-2

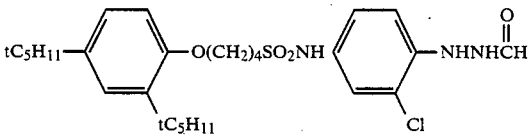

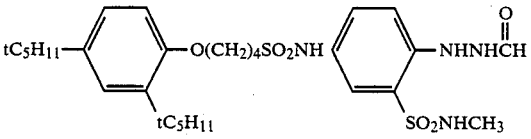

I-4

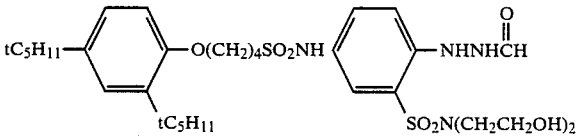

I-5

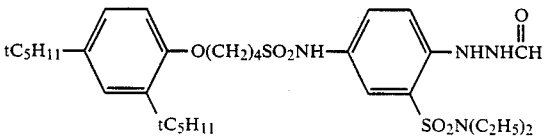

-continued
I-6
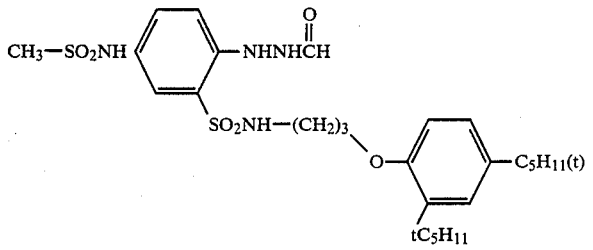
I-7
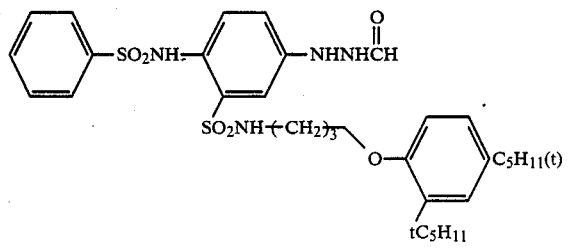
I-8
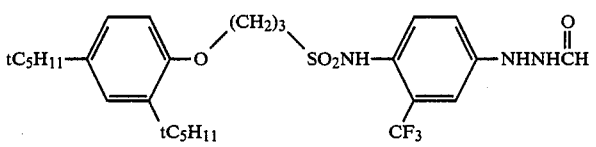
I-9
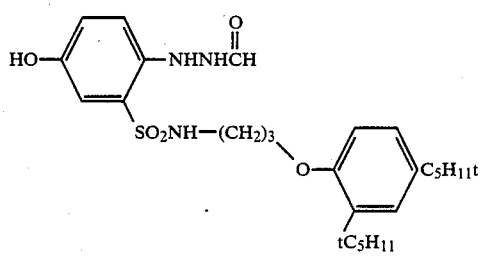
I-10
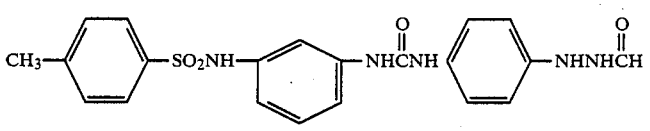
I-11
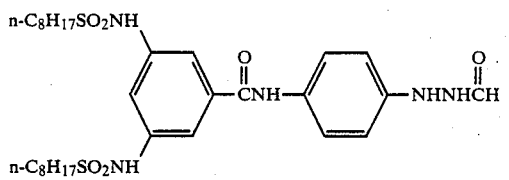
I-12
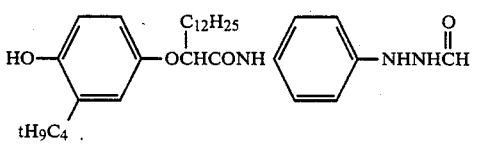
I-13
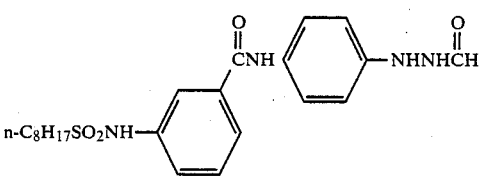

-continued
I-14
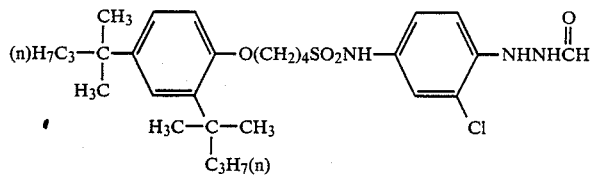
I-15
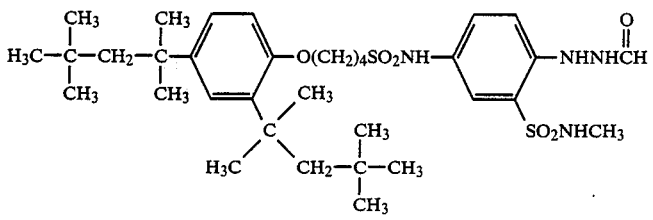
I-16
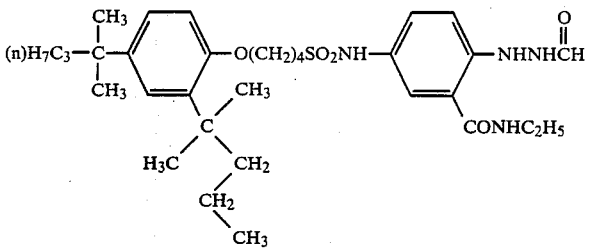
I-17
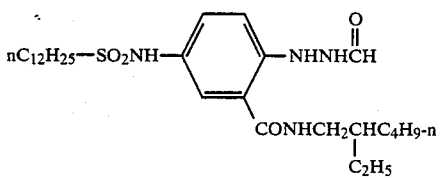
I-18
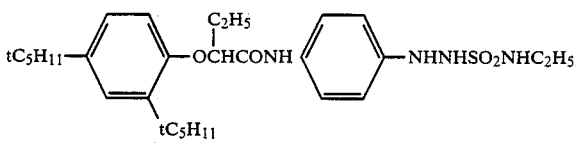
I-19
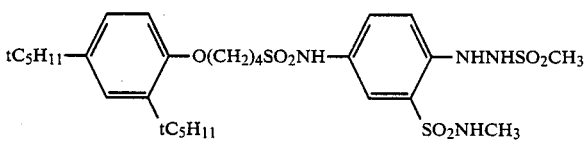
I-20
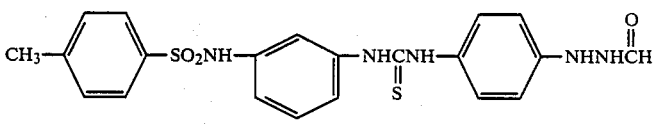
I-21
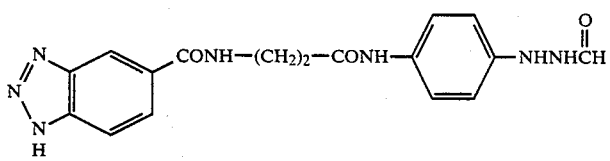
I-22
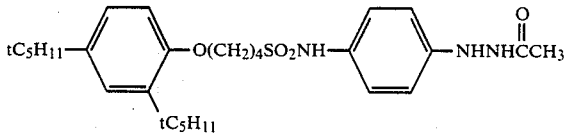

-continued
I-23
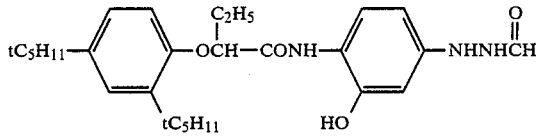
I-24
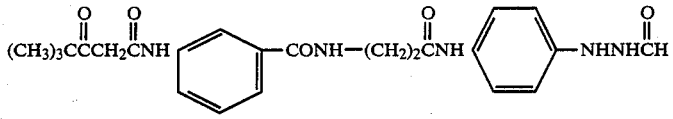
I-25
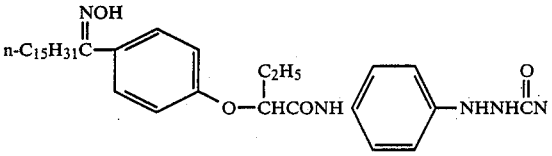
I-26
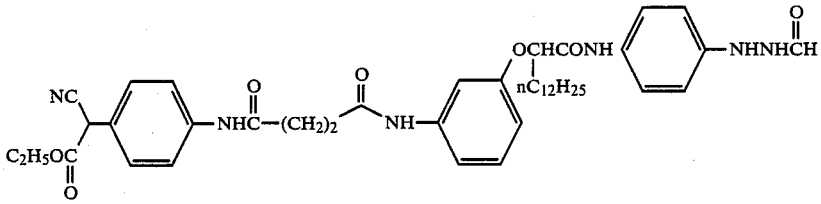
I-27
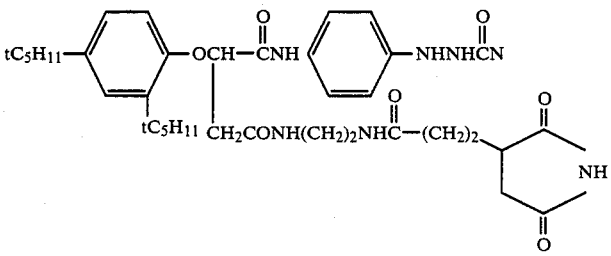
I-28
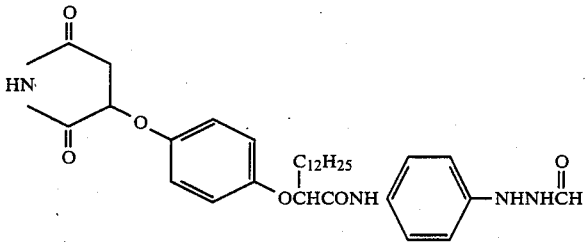
I-29
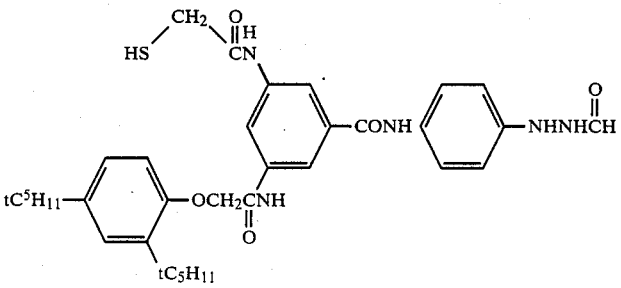

-continued

I-30

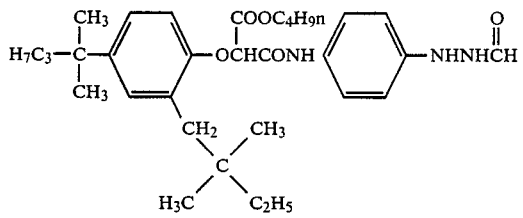

The second method to incorporate hydrazine derivatives in the non-diffusing condition is a method in which a hydrazine compound containing an adsorbing group (e.g., a mercapto group and a thiourea group) is preliminarily adsorbed in a layer other than the silver halide emulsion layer which has a substantial influence upon image density (e.g., silver halide particles and colloid silver not subjected to chemical ripening), and diffused during development. Preferred hydrazine compounds containing a group accelerating adsorption onto silver halide particles are represented by formula (II)

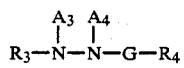

(II)

wherein $A_3$ and $A_4$ both represent atoms, or one of $A_3$ and $A_4$ represents a hydrogen atom and the other represents a sulfinic acid residue; $R_3$ represents an aliphatic group, an aromatic group, or a heterocyclic group; $R_4$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group (>C=NH), provided that at least one of $R_3$ and $R_4$ contains at least one group of a mercapto group (—SH), a thiocarbonyl group (—C=S), or an azole ring.

The aliphatic group represented by $R_3$ in formula (II) preferably has from 1 to 30 carbon atoms, and particularly preferably is a straight, branched, or cyclic alkyl group, having from 1 to 20 carbon atoms.

The saturated heterocyclic group represented by $R_3$ in formula (II) is preferably a 3- to 10-membered ring having at least one of an oxygen atom, a nitrogen atom, or a sulfur atom. These alkyl group and saturated heterocyclic group represented by $R_3$ may be substituted by the following substituents. Typical examples of the substituents include an aryl group having from 6 to 20 carbon atoms, an alkoxy group having from 1 to 20 carbon atoms, a sulfoxy group having from 1 to 20 carbon atoms, a sulfonyl group having from 1 to 20 carbon atoms, a sulfonamido group having up to 20 carbon atoms, a carbonamido group having from 1 to 20 carbon atoms, or a saturated heterocyclic group.

The aromatic or heterocyclic group represented by $R_3$ in formula (II) is preferably a monocyclic or dicyclic aryl group or a 5- or 6-membered aromatic heterocyclic group containing at least one of an oxygen atom, a nitrogen atoms, or a sulfur atom. The aromatic heterocyclic group may condense with a monocyclic or dicyclic aryl group to form a condensed ring. Preferred examples of the aromatic or heterocyclic group include a phenyl group, a naphthyl group, a pyridyl group, a pryimidyl group, an imidazolyl group, a pyrazolyl group, a quinolyl group, an isoquinolyl group, a benzimidazole group, a thiazole group, and a benzothiazole group. Of these compounds, these containing a benzene ring are particularly preferred.

A particularly preferred example represented by $R_3$ in formula (II) is an aryl group.

The aryl group represented by $R_3$ in formula (II) may have one or more substituents.

Typical examples of substituents include a straight, branched, or cyclic alkyl group (preferably having from 1 to 20 carbon atoms), an aralkyl group (preferably a monocyclic or dicyclic group in which the alkyl portion has from 1 to 3 carbon atoms), an alkoxy group or aryloxy group (preferably having from 1 to 20 carbon atoms), monosubstituted or disubstituted amino group (preferably an amino group substituted with an alkyl group having from 1 to 20 carbon atoms, and in the case of a disubstituted amino group, an amino group substituted with an alkyl group having 20 or less carbon atoms), a sulfamoyl group (preferably having from 1 to 20 carbon atoms), a carbamoyl group (preferably having from 1 to 20 carbon atoms), a substituted or unsubstituted alkylcarbonamido group (preferably having from 2 to 30 carbon atoms), a substituted or unsubstituted arylcarbonamido group (preferably having from 7 to 30 carbon atoms), a substituted or unsubstituted alkylsulfonamide or arylsulfonamido group (preferably having from 1 to 30 or from 6 to 30 carbon atoms), a mono- to tri-substituted or unsubstituted ureido group (preferably having from 1 to 30 carbon atoms), a substituted or unsubstituted aryl group (preferably a monocyclic or dicyclic aryl group having from 6 to 30 carbon atoms), a substituted or unsubstituted arylthio group (preferably a monocyclic or dicyclic arylthio group having from 6 to 30 carbon atoms), a substituted or unsubstituted alkylsulfinyl group (preferably having from 1 to 30 carbon atoms), a substituted or unsubstituted arylsulfinyl group (preferably a monocyclic or dicyclic arylsulfinyl group having from 6 to 30 carbon atoms), a substituted or unsubstituted alkylsulfonyl group (preferably having from 1 to 30 carbon atoms), a substituted or unsubstituted arylsulfonyl group (preferably a monocyclic or dicyclic arylsulfonyl group having from 6 to 30 carbon atoms), a hydroxy group, a halogen atom (for example, F, Cl, Br, or I), a substituted or unsubstituted alkylthio group (preferably having from 1 to 30 carbon atoms), and the like.

Typical examples of substituents for the above alkylcarbonamido or arylcarbonamido group, or sulfonamido group include an alkoxy group (preferably having from 1 to 20 carbon atoms), an aryloxy group (preferably having from 6 to 26 carbon atoms), an alkylthio group (preferably having from 1 to 20 carbon atoms), an alkylsulfonyl group (preferably having from 1 to 20 carbon atoms), a halogen atom (for example, F, Cl, Br, or I), a mono- to tri-substituted ureido group (preferably having from 1 to 30 carbon atoms), and the like.

Preferred substituents for the above ureido group include a substituted or unsubstituted, straight, branched, or cyclic alkyl group (preferably having from 1 to 30 carbon atoms), a substituted or unsubstituted phenyl group, a substituted or unsubstituted naphthyl group, and the like.

The above substituents may be substituted with the following substituents. Examples of the substituents include an alkoxy group having from 1 to 20 carbon atoms, an aryloxy group having from 6 to 20 carbon atoms, an alkylthio group having from 1 to 20 carbon atoms, an alkylsulfonyl group having from 1 to 20 carbon atoms, an alkylcarbonamido group having from 1 to 20 carbon atoms, an arylcarbonamido group having from 7 to 20 carbon atoms, an alkylcarbamoyl group having from 1 to 20 carbon atoms, an arylcarbamoyl group having from 7 to 20 carbon atoms, an alkylsulfamoyl group having from 1 to 20 carbon atoms, an arylsulfamoyl group having from 6 to 20 carbon atoms, a hydroxy group, —COOM or —$SO_3M$ (wherein M represents a hydrogen atom, an alkali metal atom, or a substituted or unsubstituted ammonium group), an aryl group having from 6 to 20 carbon atoms, an alkylsulfoxy group having from 1 to 20 carbon atoms, an arylsulfoxy group having from 6 to 20 carbon atoms, a halogen atom (for example, F, Cl, Br, or I), and the like. These groups may be bonded with each other to form a ring.

The alkyl group represented by $R_4$ in formula (II) is preferably an alkyl group having from 1 to 7 carbon atoms. For example, the alkyl group may be substituted with the following substituents.

Typical examples of substituents for the alkyl group include a halogen atom (for example, F, Cl, Br, or I), a cyano group, —COOM or —$SO_3M$ (wherein M represents a hydrogen atom, an alkali metal atom, or a substituted or unsubstituted ammonium group), an alkoxy group having from 1 to 20 carbon atoms, a phenyl group, an aryloxy group having from 6 to 26 carbon atoms, an alkylthio group having from 1 to 20 carbon atoms, a sulfamoyl group having up to 20 carbon atoms, a sulfonamido group having from 1 to 20 carbon atoms, an alkylcarbonyl group having from 1 to 20 carbon atoms, a formyl group, an arylcarbonly group having from 7 to 20 carbon atoms, a hydroxy phenyl group, an alkylcarbonamido or an alkylcarbamoyl group having from 1 to 20 carbon atoms, an arylcarbonamido or an arylcarbamoyl group having from 7 to 20 carbon atoms, and the like.

The aryl group represented by $R_4$ in formula (II) is preferably a monocyclic or dicyclic aryl group having from 6 to 20 carbon atoms (for example, an arylyl group containing a benzene ring).

The aralkyl group may be substituted with the following substituents.

Typical examples of the substituents for the aralkyl group include a halogen atom (e.g., F, Cl, Br, or I), a cyano group, an alkyl group (preferably having from 1 to 20 carbon atoms), —COOM or —$SO_3M$ (wherein M represents a hydrogen atom, an alkali metal atom, or a substituted or unsubstituted ammonium group), an alkylthio group (preferably having from 1 to 20 carbon atoms), and the like.

The alkoxy group represented by $R_4$ in formula (II) is preferably an alkoxy group having from 1 to 8 carbon atoms. The alkoxy group may be substituted with the following substituents. For example, the substituents for the alkoxy group include a halogen atom (e.g., F, Cl, Br, or I), an aryl group (preferably having from 6 to 26 carbon atoms), and the like.

The aryloxy group represented by $R_4$ in formula (II) is preferably a monocyclic group having from 6 to 26 carbon atoms which may be substituted with a halogen atom (e.g., F, Cl, Br, or I).

When G is a carbonyl group, $R_4$ is preferably a hydrogen atom, a methyl group, an ethoxy group, a trifluoromethyl group, 3-hydroxy propyl group, 3-methanesulfonamido propyl group, 2-acetylethyl group, a phenyl group, a 3,5-dichlorophenyl group, a 4-methanesulfonyl phenyl group, a 3,5-dimethanesulfonyl phenyl group, a 3,5-disulfamoyl phenyl group, an o-hydroxybenzyl group, an o-methanesulfonamido phenyl group, or the like. Of these, a hydrogen atom is particularly preferred.

When G is a sulfonyl group, $R_4$ is preferably a methyl group, an ethyl group, a phenyl group, a 4-methylphenyl group, an o-hydroxybenzyl group, a 2-acetylethyl group, or the like. Of these, a methyl group is particularly preferred.

When G is a phosphoryl group, $R_4$ is preferably two groups selected from the group consisting of a methoxy group, an ethoxy group, a butoxy group, a phenoxy group, or the like, provided that at least one of the two groups is preferably a phenoxy group.

When G is a sulfoxy group, $R_4$ is preferably a cyanobenzyl group, amethylbenzyl group, or the like.

When G is iminomethylene group, $R_4$ is preferably a methyl group, an ethyl group, a substituted or unsubstituted phenyl group, or the like.

Among groups represented by G, a carbonyl group is particularly preferred. Among groups represented by $A_3$ and $A_4$, a hydrogen atom is particularly preferred.

A mercapto group which is contained in at least one of $R_3$ and $R_4$ is a mercapto group substituted to an aliphatic group, an aromatic, or a heterocyclic group.

A thiocarbonyl group which is contained in at least one of $R_3$ and $R_4$ is a substituted or unsubstituted thioamido group, a substituted or unsubstituted thiourea group, a substituted or unsubstituted thiosemicarbazido group, a substituted or unsubstituted carbazido group, or the like. These groups may be cyclized to form a cyclic thioamido or a mercaptohetero ring which relates to the tautomerism.

An azole ring which is contained in at least one of $R_3$ and $R_4$ is a pyrrole ring, an imidazole ring, a pyrrazole ring, a triazole ring, a tetrazole ring, an oxazole ring, a thiazole ring, an oxadiazole ring, a thiadiazole ring, or a hetero ring thereof which is condensed with a benzene ring, a naphthalene ring, or a 5- or 6-membered hetero ring group. And further a hetero atom constituting a hetero ring is selected from the group consisting of O, N, S, Se, etc.

Among above hydrazine compounds, a mercaptotetrazole, a benzotriazole, or a mercaptothiazole compound is particularly preferred.

Preferred compounds represented by formula (II) are described in U.S. Pat Nos. 4,243,739, 4,385,108, and 4,272,614, British Pat. Nos. 1,583,471 and 2,011,391, European Pat. No. 154,293, and Japanese patent application (OPI) Nos. 52052/80 and 179734/85, and Japanese patent application No. 19739/85. Representative examples of the compounds represented by formula (II) are shown below, although the present invention is not limited thereto.

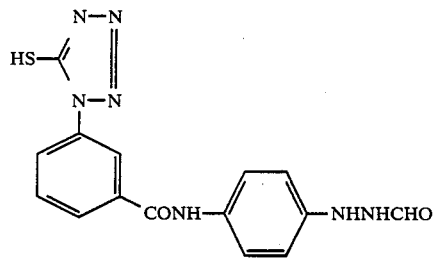
II-1
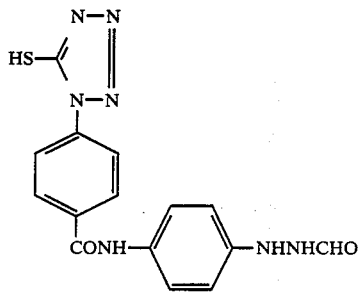
II-2
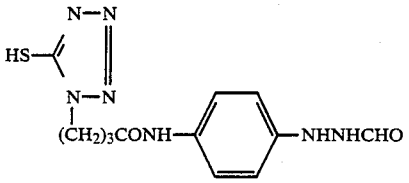
II-3
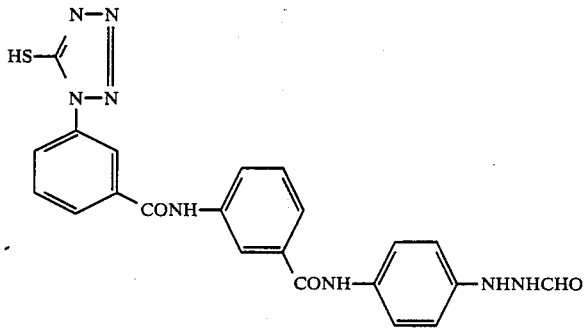
II-4
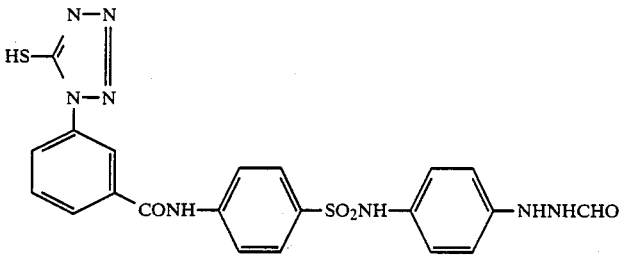
II-5
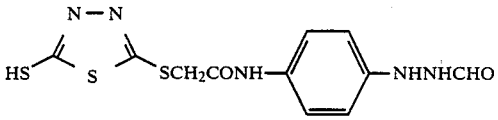
II-6
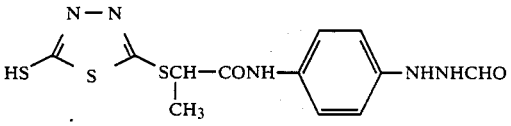
II-7

-continued
II-8
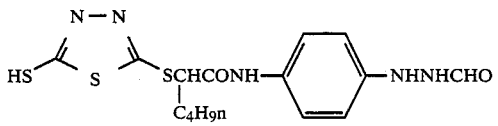
II-9
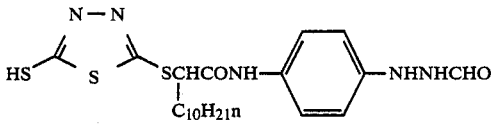
II-10
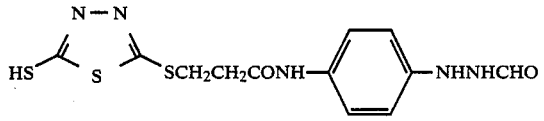
II-11
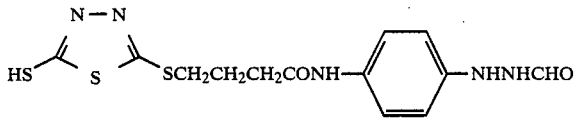
II-12
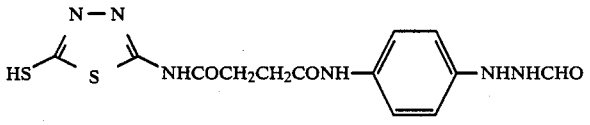
II-13
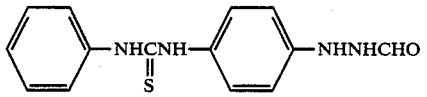
II-14
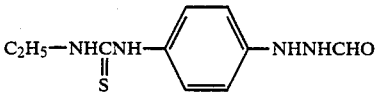
II-15
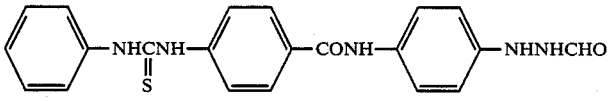
II-16
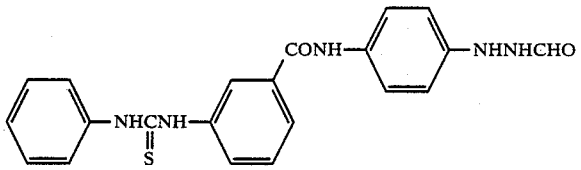
II-17
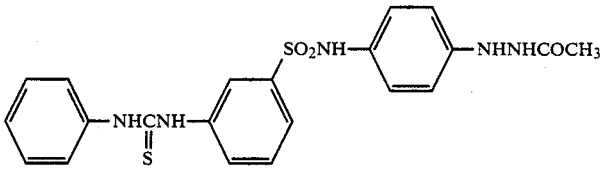
II-18
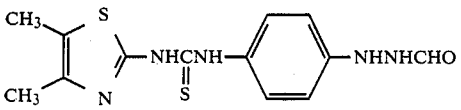

-continued
II-19
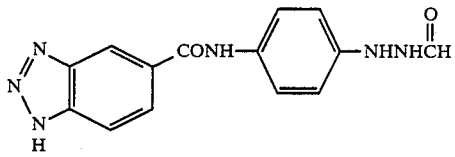
II-20
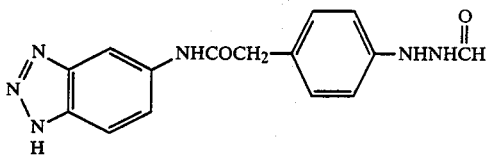
II-21
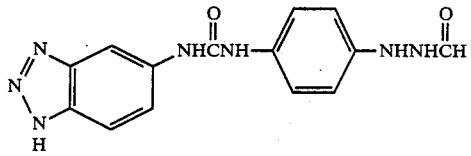
II-22
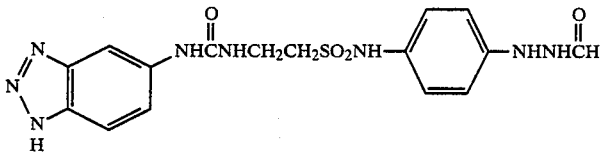
II-23
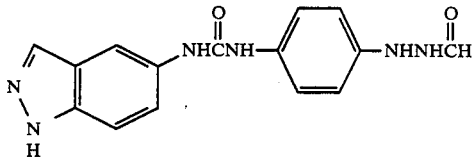
II-24
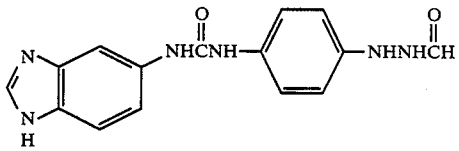
II-25
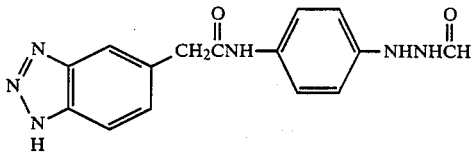
II-26
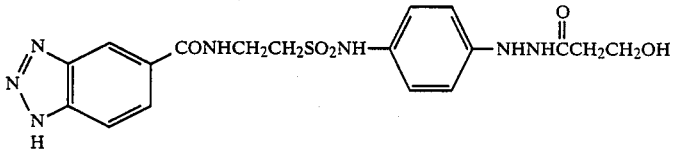
II-27
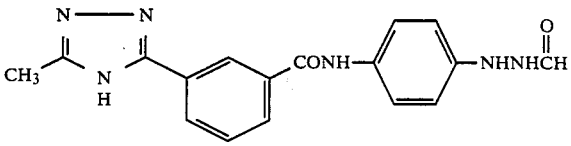

-continued

II-28

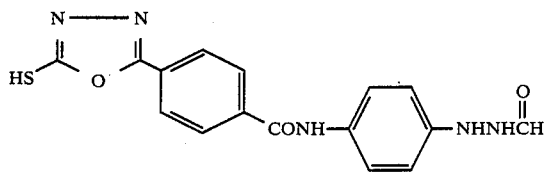

II-29

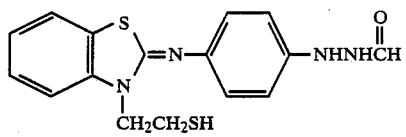

II-30

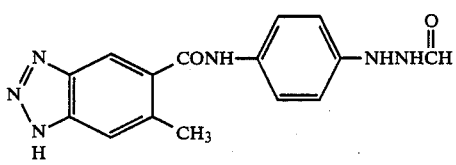

II-31

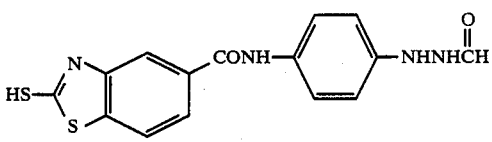

II-32

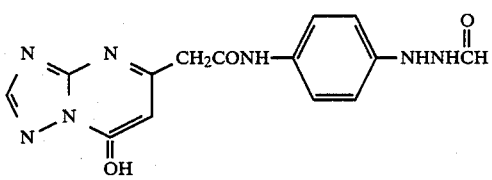

II-33

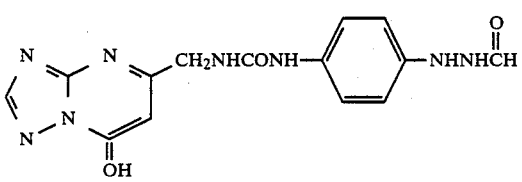

In connection with a method for adding hydrazine derivatives, it is preferable that when the hydrazine compound used is water-soluble, it is added as an aqueous solution, and when the hydrazine compound used is sparingly soluble in water, it is dissolved in an organic solvent miscible with water, such as alcohols, esters, and ketones and then added to the hydrophilic colloid solution.

The optimum amount of the hydrazine derivatives to be added can be easily determined by one skilled in the art although it varies with factors such as the grain size, the halogen composition, and method and extent of chemical sensitization of a silver halide emulsion, the relation between a layer in which the hydrazine derivatives are to be incorporated and with silver halide emulsion layer, the type of anti-foggant, and so forth. Usually, the compound is used preferbly in an amount of from $1\times10^{-6}$ to $1\times10^{-1}$ mol per mol of silver halide, and particularly preferably in an amount of from $1\times10^{-5}$ to $4\times10^{-2}$ mol per mol of silver halide.

Most preferable as an emulsion for the layer which has a substantial influence upon image density is an emulsion subjected to chemical sensitization. As a method of chemical sensitization, sulfur sensitization, reduction sensitization, and noble metal sensitization are known. These methods can be applied singly or in combination with each other. A preferred chemical sensitization method is sulfur sensitization. As sulfur sensitizing agents for the sulfur sensitization, as well as sulfur compounds contained in gelatin, various sulfur compounds such as thiosulfuric acid salts, thioureas, and rhodanines can be used. Representative examples are described in U.S. Pat. Nos. 1,574,944, 2,278,947, 2,410,689, 2,728,668, 3,501,313, and 3,656,952.

Gold sensitization, which is a typical example of noble metal sensitization, employs a gold compound, mainly a complex salt thereof. Complex salts of noble metals other than gold, such as platinum, palladium, iridium, rhodium, etc., can be incorporated. Specific examples thereof are described in U.S. Pat. No. 2,448,060, British Pat. No. 618,061, and so on.

Reduction sensitizing agents which can be used in the present invention include stannous salts, amines, formamidinesulfinic acid, silane compounds, etc. Representative examples of such reduction sensitizing agents are described in U.S. Pat. Nos. 2,487,850, 2,518,698, 2,983,609, 2,983,610, and 2,694,637.

The silver halide emulsion which can be used in present invention comprises any of silver chloride, silver chlorobromide, silver iodobromide, silver iodochlorobromide, and the like.

The average grain size of silver halide used in the present invention is preferably not more than 0.7 μm, and particularly preferably from 0.15 to 0.5 μm. Although there are no limitations to the grain size distribution, it is preferred to use monodisperse silver halide grain. The term "monodisperse silver halide grain" as used herein means that at least 95% of the silver halide grains as determined based on either weight or a number of grains, have a grain size falling within the range of the average grain size ±40%.

Silver halide grains in the photographic emulsion may have a regular form crystal, such as a cubic or an octahedral form, or an irregular form crystal, such as a spherical or a tabular form, or a composite form crystal thereof.

The silver halide grains may have a homogeneous phase or a heterogeneous phase through the surface layer to the interior thereof. Two or more different silver halide emulsions separately prepared may be used as a mixture.

In the formation of silver halide grains or the process of the physical ripening thereof, a cadmium salt, a sulfurous acid salt, a lead salt, a thallium salt, a rhodium salt, or a complex salt thereof, an iridium salt or a complex salt thereof, etc. may be present in the silver halide emulsion as described in G. F. Duffin, *Photographic Emulsion Chemistry*, The Focal Press, (1966).

A silver halide emulsion particularly suitable for use in a light-sensitive material for line image photographing and dot image formation is a silver halide which is prepared in the presence of an iridium salt or a complex salt thereof in an amount of from $1\times10^{-8}$ to $1\times10^{-5}$ mol per mol of silver, and preferably not less than 70 mol %, and particularly preferably not less than 90 mol % of which is silver bromide. The silver iodide content is preferably not more than 10 mol %, and particularly preferably from 0.1 to 5 mol %. Further, silver haloiodide in which the silver iodide content of the grain surface is greater than the average silver iodide content is preferred. When an emulsion containing such silver haloiodide is used, photographic characteristics of high sensitivity and high gamma can be obtained.

The iridium salt of the above-specified amount is desirably added to the silver halide emulsion before the completion of physical ripening, particularly during the grain formation.

Iridium salts which can be used in the present invention include water-soluble iridium salts or iridium complex salts, such as iridium trichloride, iridium tetrachloride, potassium hexachloroiridate (III), potassium hexachloroiridate (IV), ammonium hexachloroiridate (III), etc.

For the purpose of increasing sensitivity, the photographic light-sensitive materials of the present invention can contain sensitizing dyes, such as cyanine dyes, merocyanine dyes, etc., as described, for example, in U.S. Pat. No. 4,243,739.

These sensitizing dyes may be used either alone or in combination with each other. Combinations of sensitizing dyes are often used particularly for the purpose of supersensitization. The photographic emulsions may contain, in addition to the sensitizing dyes, a dye which has per se no spectrally sensitizing effect or a substance which does not substantially absorb visible light, but said dye or substance exhibiting super-sensitizing effect.

Specific examples of useful sensitizing dyes, combinations of dyes for supersensitization, and substances exhibiting supersensitizing effect are disclosed, for example, in *Research Disclosure*, Vol. 176, RD No. 17643, page 23, (Dec., 1979), IV-J and U.S. Pat. No. 4,234,739.

The photographic light-sensitive materials according to the present invention can contain various compounds known as antifoggants or stabilizers for the purpose of preventing fog during preparation, preservation, or photographic processing of the photographic materials, or for stabilizing photographic performances. Examples of such compounds include azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds, e.g., oxazolinethione, etc.; azaindenes, e.g., triazaindenes, tetraazaindenes (especially 4-hydroxy-substituted (1,3,3a7)tetraazaindenes), pentaazaindenes, etc.; benzenethiosulfonic acid; benzenesulfinic acid; benzenesulfonic acid amide; and the like. Preferred among them are benzotriazoles, e.g., 5-methylbenzotriazole and nitroindazoles, e.g., 5-nitroindazole. These compounds may also be incorporated in a processing solution.

The photographic emulsion layers or a light-insensitive hydrophilic colloid layers of the photographic light-sensitive materials of the present invention may contain an organic or inorganic hardener, such as a chromium salt, e.g., chrominum alum, chromium acetate, etc.; an aldehyde, e.g., formaldehyde, glyoxal, glutaraldehyde, etc.; an N-methylol compound, e.g., dimethylolurea, methyloldimethylhydantoin, etc.; dioxane derivatives, e.g., 2,3-dihydroxydioxane, etc.; an active vinyl compound, e.g., 1,3,5-triacryloyl-hexahydro-s-triazine, 1,3-vinylsulfonyl-2-propanol, etc.; an active halogen compound, e.g., 2,4-dichloro-6-hydroxy-s-triazine, etc.; a mucohalogenic acid, e.g., mucochloric acid, mucophenoxychloric acid, etc.; epoxy compounds, e.g., tetramethylene glycol diglycidyl ether, etc.; isocyanate compounds, e.g., hexamethylene diisocyanate, etc.; and the like, either alone or in combinations thereof.

The photographic emulsion layers or the light-insensitive hydrophilic colloid layers of the photographic light-sensitive materials of the present invention may further contain a large variety of surface active agents for various purposes, for example, as coating aids, as antistatic agents, for improvement of sliding properties, as emulsification or dispersion, for prevention of adhesion, for improvement of photographic characteristics (e.g., development acceleration, increasing contrast, increasing sensitivity, etc.), and the like.

Examples of the surface active agents to be used in the present invention include nonionic surface active agents such as saponin (steroid type), alkylene oxide derivatives, e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone, etc., glycidol derivatives, e.g., alkenylsuccinic polyglycerides, alkylphenyl polyglycerides, etc., fatty acid esters of polyhydric alcohols, alkyl esters of sugars, and the like;

anionic surface active agents containing acidic groups, e.g., a carboxyl group, a sulfo group, a phospho group, a sulfuric ester group, a phosphoric ester group, etc., such as alkylcarboxylates, alkylsulfonates, alkylbenzenesulfonates, alkylnaphthalenesulfonates, alkylsulfates, alkylphosphates, N-acyl-N-alkyltaurins, sulfosuccinates, sulfoalkylpolyoxyethylene alkylphenyl ethers, polyoxyethylene alkylphosphates, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Of these compounds, polyalkylene oxides having a molecular weight of 600 or more, as described in U.S. Pat. No. 4,221,857, are preferably used in the present invention. Also, for the purpose of increasing dimensional stability, latexes of polymers such as polyalkyl acrylate can be incorporated.

The photographic emulsion layer or hydrophilic colloid layer of the photographic light-sensitive material of the present invention may contain a matting agent such as silica, magnesium oxide, and polymethyl methacrylate for the purpose of preventing adhesion.

The light-sensitive material of the present invention may contain a dispersion of a water-soluble or sparingly soluble synthetic polymer for the purpose of improving its dimensional stability. For example, homo- and copolymers of monomers such as alkyl acrylate or alkyl methacrylate, alkoxyalkyl acrylate or alkoxyalkyl methacrylate, glycidyl acrylate or glycidyl methacrylate, acrylamide or metharcylamide, vinyl esters (e.g., vinyl acetate), acrylonitrile, olefin and styrene; and copolymers of the above monomers and comonomer such as acrylic acid, methacrylic acid, $\alpha,\beta$-unsaturated dicarboxylic acid, hydroxy alkyl acrylate or hydroxy alkyl methacrylate, sulfoalkyl acrylate or sulfoalkyl methacrylate, and styrenesulfonic acid can be used. Polymers as described in U.S. Pat. Nos. 2,376,005, 2,739,137, 2,853,457, 3,062,674, 3,411,911, 3,525,620, 3,607,290, and 3,645,740 can also be used.

As a binder or protective colloid for use in the light-sensitive material of the present invention, it is advantageous to use gelatin. In addition, hydrophilic synthetic polymers and the like can be used. As the gelatin, lime-treated gelatin, acid-treated gelatin, gelatin derivatives and the like can be used. Representative examples are described in *Research Disclosure*, Vol. 176, RD No. 17643 (Dec., 1978), IX.

In obtaining photographic characteristics of super high contrast and high sensitivity using the silver halide light-sensitive material of the present invention, it is not necessary to use the conventional infectious developers or high alkali developers having a pH of about 13 as described in U.S. Pat. No. 2,419,975; and a stable developer can be used.

That is, the silver halide photographic material of the present invention can provide negative images of sufficiently high contrast having a gamma ($\gamma$) of more than 10 when developed with a developer containing at least 0.15 mol/liter (developer), and preferably from 0.2 to 0.8 mol/liter (developer) of sulfite ion and having a pH of from 10.5 to 12.3, particularly from 11.0 to 12.0.

The developing agent for use in the developer which can be used in the present invention is not critical. Dihydroxybenzenes are preferred in that good dot quality can be easily obtained. In some cases, a combination of dihydroxybenzenes and 1-phenyl-3-pyrazolidones or a combination of dihydroxybenzenes and p-aminophenols may be used.

Dihydroxybenzene developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, and the like. Particularly preferred is hydroquinone.

Examples of the 1-phenyl-3-pyrazolidone or its derivative developing agent which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl- 4,4-dimethyl-3-pyrazolidone. Particularly preferred is 1-phenyl-3-pyrazolidone, 1-phenyl-4,4-dimethyl-3-pyrazolidone, or 1-phenyl-4-methyl-4-hydroxymethyl-3-pyrazlidone.

Examples of the p-aminophenol developing agent which can be used in the present invention include N-methyl-p-aminophenol, p-aminophenol, N-($\beta$-hydroxyethyl)-p-aminophenol, N-(4-hydroxyphenyl)glycine, 2-methyl-p-aminophenol, and p-benzylaminophenol. Of these compounds, N-methyl-p-aminophenol is preferred.

The amount of the developing agent used is preferably from 0.05 to 0.8 ml/liter. When dihydroxybenzenes are used in combination with 1-phenyl-3-pyrazolidones or p-aminophenols, it is preferred that the dihydroxybenzenes be used in an amount of preferably from 0.05 to 0.6 mol/liter (developer) and particularly from 0.2 to 0.5 mol/liter (developer), and the 1-phenyl-3-pyrazolidones or p-aminophenols be used in an amount of not more than 0.06 mol/liter (developer) and particularly from 0.001 to 0.03 mol/liter (developer).

Examples of the sulfurous acid salt which is used as a preservative in the present invention include sodium sulfite, potassium sulfite, lithium sulfite, ammonium sulfite, sodium hydrogensulfite, potassium metahydrogensulfite, and sodium formaldehyde hydrogensulfite. The amount of the sulfurous acid salt used is preferably not less than 0.4 mol/liter (developer), particularly preferably not less than 0.5 mol/liter (developer). The upper limit is preferably up to 2.5 mol/liter (developer).

An alkali agent which is used to adjust the pH includes pH adjustors and buffers such as sodium hydroxide, potassium hydroxide, sodium carbonate, potassium carbonate, sodium triphosphate, and potassium triphosphate.

Additives other than the above-described ones which may be contained include development inhibitors such as boric acid, borax, sodium bromide, potassium bromide, and potassium iodide; organic solvents such as ethylene glycol, diethylene glycol, triethylene glycol, dimethylformamide, methyl cellosolve, hexylene glycol, ethanol, and methanol; and antifoggants or black pepper inhibitors such as mercapto compounds, e.g., 1-phenyl-5-mercaptotetrazole and sodium 2-mercaptobenzimidazole-5-sulfonate, indazole compounds, e.g., 5-nitroindazole, and benzotriazole compounds, e.g., 5-methylbenzotriazole. In addition, if desired, a color adjustor, a surfactant, a defoaming agent, a hard water-softening agent, a hardener, amino compounds as described in U.S. Pat. No. 4,269,929, and so forth may be added.

The present invention is described in greater detail with reference to the following examples.

EXAMPLE 1

An aqueous solution of silver nitrate and an aqueous solution of potassium iodide and potassium bromide were added at the same time to an aqueous solution of gelatin maintained at 50° C. in the presence of $4\times10^{-7}$ mol per mol of silver of potassium iridium (III) hexachloride and ammonia over 60 minutes. During this period, pAg was maintained at 7.8. In this way, there was prepared a cubic monodisperse emulsion having an average particle diameter of 0.25 μm and an average silver iodide content of 1 mol %. To this silver iodobromide emulsion were added a 5,5'-dichloro-9-ethyl-3,3'-bis(3-sulfopropyl)oxacarbocyanine solidum salt as a sensitizing dye, 4-hydroxy-6-methyl-1,3,3a,7-tetraazaindene as a stabilizer, a dispersion of polyethyl acrylate, 1,3-divinylsulfonyl-2-propanol and Compound I-2 of the present invention or a comparative compound. Compound I-2 and the comparative compound were added to an emulsion layer (amount of Ag coated: 3.4 g/m$^2$) and a gelatin lower layer (amount of gelatin coated: 1.0 g/m$^2$). These emulsion and gelatin layers and further a protective layer were coated at the same time to prepare Sample Nos. 1 to 7. Each sample was exposed and developed, and then its photographic characteristics were measured.

A developer having the following formulation was used.

| Developer | |
|---|---|
| Hydroquinone | 35.0 g |
| N-methyl-p-aminophenol ½ sulfate | 0.8 g |
| Sodium hydroxide | 9.0 g |
| Potassium triphosphate | 74.0 g |
| Potassium sulfite | 90.0 g |
| Disodium ethylenediaminetetraacetate | 1.0 g |
| 3-Diethylamino-1-propanol | 15.0 g |
| 5-Methylbenzotriazole | 0.5 g |
| Sodium bromide | 3.0 g |
| Water to make | 1 liter |

(pH = 11.60)

TABLE 1

| Sample No. | Compound | Amount Added to Layers (mol/mol Ag) Emulsion Layer | Gelatin Layer | Photographic Characteristics Sensitivity | gamma | Evaluation of Black Spots I | II |
|---|---|---|---|---|---|---|---|
| 1* | I-2 | $2.7\times10^{-3}$ | — | 100 | 17.5 | 2.0 | 1.5 |
| 2* | " | $3\times10^{-3}$ | — | 110 | 17.5 | 1.5 | 1 |
| 3 | " | — | $3\times10^{-3}$ | 85 | 13.5 | 4.5 | 4.5 |
| 4 | " | — | $3.6\times10^{-3}$ | 93 | 15.5 | 4.0 | 4.0 |
| 5 | " | — | $4.2\times10^{-3}$ | 102 | 17.5 | 3.5 | 3.5 |
| 6* | Comparative Compound A | $3.0\times10^{-3}$ | — | 100 | 16 | 2 | 1 |
| 7* | Comparative Compound A | — | $3.0\times10^{-3}$ | 100 | 16 | 2 | 1 |

(Note)
*: Comparative examples

Comparative Compound A: 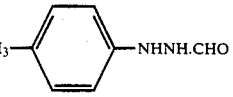

The sensitivity is a relative value of the reciprocal of an exposure amount to provide a density of 1.5 by development at 38° C. for 30 seconds, and is indicated as a relative value with that of Sample 1 being taken as 100.

The black spots were examined with a microscope and evaluated by five grade evaluation: the value of 5 is best and the value of 1 is worst, with "5" and "4" being practicably usable, "3" being poor but still usable, and "2" and "1" being practicably unusable. An intermediate between "4" and "3" is "3.5," etc. Black Spot Evaluation I indicates the results when development was conducted at 38° C. for 40 seconds, and Black Spot Evaluation II indicates the results when after being allowed to stand under conditions of 50° C. and 75% RH for 3 days, the sample was developed at 38° C. for 40 seconds.

As can be seen from the results of Table 1, in Samples 3 to 5 according to the present invention, the resistance to black spot formation was improved, without substantially decreasing the sensitivity, and is much better than Comparative Samples 1, 2, 6, and 7.

EXAMPLE 2

A primitive cubic monodisperse emulsion having an average grain size of 0.2 μm and an average silver iodide content of 0.1 mol % was prepared in the same manner as in Example 1. To this primitive silver iodobromide emulsion was added Compound II-1, which was then stirred at 40° C. for 30 minutes and allowed to stand. An upper layer of the emulsion of Example 1 (amount of silver coated: 3.0 g/m$^2$), a lower layer of the emulsion as prepared above (amount of silver coated: 0.5 g/m$^2$), and a protective layer were coated at the same time to prepare Sample Nos. 11 to 15. These samples were exposed and developed with the same developer as used in Example 1, and their photographic characteristics were measured. As can be seen from the results of Table 2, in Samples 14 to 15 of the present invention, the resistance to black spots was improved without substantially decreasing the sensitivity, and the black spot improving effect was significant as compared with Comparative Samples 11 to 13.

TABLE 2

| Sample No. | Added Amount of Compound II-1 (mol/mol Ag) Upper Layer (Chemical Sensitization) | Lower Layer (primitive) | Photographic Characteristics Sensitivity | gamma | Evaluation of Black Spot I |
|---|---|---|---|---|---|
| 11* | $6 \times 10^{-5}$ | — | 102 | 17 | 2 |
| 12* | $8 \times 10^{-5}$ | — | 112 | 16.5 | 1 |
| 13* | $1 \times 10^{-4}$ | — | 126 | 16.5 | 1 |
| 14 | — | $1 \times 10^{-4}$ | 100 | 13.0 | 4 |
| 15 | — | $2 \times 10^{-4}$ | 117 | 16.0 | 3.0 |

(Note)
*Comparative examples

The photographic characteristics and black spots were evaluated in the same manner as in Example 1.

EXAMPLE 3

The same manner as in Example 2 was repeated, except that Compound II-6 or II-19, of the present invention was added to the primitive silver iodobromide emulsion in place of Compound II-1, And their photographic characteristics were measured by the same method as in Example 1. As a result, the resistance to black spots was improved without substantially decreasing the sensitivity and the gamma.

In the light-sensitive material of the present invention, hydrazine derivatives in the non-diffusing condition are incorporated in a hydrophilic colloid layer other than a silver halide emulsion layer which has a substantial influence upon image density, and thus photographic characteristics that the formation of black spots is decreased, and the sensitivity and contrast are high can be obtained.

While the invention has been described in detail and with reference to specific embodiments thereof, it will be apparent to one skilled in the art that various changes and modifications can be made therein without departing from the spirit and scope thereof.

What is claimed is:

1. A negative type silver halide photographic material comprising a support having provided thereon at least one silver halide emulsion layer which has a substantial influence upon image density and at least one light-insensitive hydrophilic colloid layer, wherein a hydrophilic colloid layer other than said silver halide emulsion layer contains a hydrazine derivative in a non-diffusing condition, wherein the hydrophilic colloid layer which contains the hydrazine derivative in a non-diffusing condition is a light-insensitive layer which does not have a substantial influence on image density, and wherein said hydrazine derivative is represented by formula (I):

$$R_1-\overset{A_1}{\overset{|}{N}}-\overset{A_2}{\overset{|}{N}}-G-R_2 \qquad (I)$$

wherein $A_1$ and $A_2$ both represent hydrogen atoms, or one of $A_1$ and $A_2$ represents a hydrogen atom and the other represents a sulfinic acid residue; $R_1$ represents an aliphatic group, an aromatic group, or a heterocyclic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group, provided that at least one of $R_1$ and $R_2$ contains at least one group having a pKa of from 8 to 13 which is capable of dissociating into an anionic ion.

2. A negative type silver halide photographic material as in claim 1, wherein said compound represented by formula (I) does not contain a group having a pKa of less than 8 and in which when the substituents are considered in combination the quotient of (molecular weight)/(number of dissociable groups plus 1) is from 150 to 650.

3. A negative type silver halide photographic material as in claim 1, wherein said hydrazine derivative contains an adsorbing group.

4. A negative type silver halide photographic material as in claim 1, wherein the hydrazine derivative is present in an amount of from $1\times10^{-6}$ to $1\times10^{-1}$ mol per mol of silver halide in said hydrophilic colloid layer.

5. A negative type silver halide photographic material as in claim 1, wherein the hydrazine derivative is present in an amount of from $1\times10^{-5}$ to $4\times10^{-2}$ mol per mol of silver halide in said hydrophiic colloid layer.

6. A process for forming a super high contrast negative image which comprises imagewise exposing a negative type silver halide photographic material comprising a support having provided thereon at least one silver halide emulsion layer which has a substantial influence upon image density and at least one light-insensitive hydrophilic colloid layer, wherein a hydrophilic colloid layer other than said silver halide emulsion layer contains a hydrazine derivative in a non-diffusing condition, and then developing the photographic material with a developer containing not less than 0.15 mol/liter of sulfite ions and having a pH of from 10.5 to 12.3, and wherein said hydrazine derivative is represented by formula (I):

$$R_1-\overset{A_1}{\overset{|}{N}}-\overset{A_2}{\overset{|}{N}}-G-R_2 \qquad (I)$$

wherein $A_1$ and $A_2$ both represent hydrogen atoms, or one of $A_1$ and $A_2$ represents a hydrogen atom and the other represents a sulfinic acid residue; $R_1$ represents an aliphatic group, an aromatic group, or a heterocyclic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group, provided that at least one of $R_1$ and $R_2$ contains at least one group having a pKa of from 8 to 13 which is capable of dissociating into an anionic ion.

7. A process for forming a super high contrast negative image as in claim 6, wherein said compound represented by formula (I) does not contain a group having a pKa of less than 8 and in which when the substituents are considered in combination the quotient of (molecular weight)/(number of dissociable groups plus 1) is from 150 to 650.

8. A process for forming a super high contrast negative image as in claim 6, wherein said hydrazine derivative contains an adsorbing group.

9. A process for forming a super high contrast negative image as in claim 6, wherein the hydrazine derivative is present in an amount of from $1\times10^{-6}$ to $1\times10^{-1}$ mol per mol of silver halide in said hydrophilic colloid layer.

10. A process for forming a super high contrast negative image as in claim 6, wherein the hydrazine derivative is present in an amount of from $1\times10^{-5}$ to $4\times10^{-2}$ mol per mol of silver halide in said hydrophilic colloid layer.

11. A negative type silver halide photographic material as in claim 1, wherein said hydrophilic colloid layer additionally contains a compound represented by formula (II)

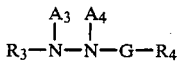

(II)

wherein $A_3$ and $A_4$ both represent hydrogen atoms, or one of $A_3$ and $A_4$ represents a hydrogen atom and the other represents a sulfinic acid residue; $R_3$ represents an aliphatic group, an aromatic group, or a heterocyclic group; $R_4$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group (>C=NH), provided that at least one of $R_3$ and $R_4$ contains at least one group of a mercapto group (—SH), a thiocarbonyl group (—C=S), or an azole ring.

12. A process for forming a super high contrast negative image as in claim 6, wherein said hydrophilic colloid layer additionally contains a compound represented by formula (II)

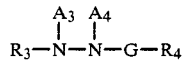

(II)

wherein $A_3$ and $A_4$ both represent hydrogen atoms, or one of $A_3$ and $A_4$ represents a hydrogen atom and the other represents a sulfinic acid residue; $R_3$ represents an aliphatic group, an aromatic group, or a heterocyclic group; $R_4$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group (>C=NH), provided that at least one of $R_3$ and $R_4$ contains at least one group of a mercapto group (—SH), a thiocarbonyl group (—C=S), or an azole ring.

13. A negative type silver halide photographic material as in claim 1, wherein the light-insensitive layer is a light-insensitive hydrophilic colloid layer or a silver halide emulsion layer which does not have a substantial influence on image density.

14. A negative type silver halide photographic material as in claim 13, wherein the light-insensitive layer is a light-insensitive hydrophilic colloid layer.

15. A negative type silver halide photographic material as in claim 13, wherein the light-insensitive layer is a silver halide emulsion layer which does not have a substantial influence on image density.

16. A process for forming a super high contrast negative image as in claim 6, wherein the light-insensitive layer is a light-insensitive hydrophilic colloid layer or a silver halide emulsion layer which does not have a substantial influence on image density.

17. A process for forming a super high contrast negative image as in claim 16, wherein the light-insensitive layer is a light-insensitive hydrophilic colloid layer.

18. A process for forming a super high contrast negative image as in claim 16, wherein the light-insensitive layer is a silver halide emulsion layer which does not have a substantial influence on image density.

* * * * *